US006460694B1

(12) United States Patent
Khanna et al.

(10) Patent No.: US 6,460,694 B1
(45) Date of Patent: Oct. 8, 2002

(54) POLYETHYLENE-LAMINATED FIBER AMMUNITION CONTAINER

(75) Inventors: Vishwa Khanna, Randolph, NJ (US); Yuen H. Lam, Parsippany, NJ (US); James F. Zoll, Flanders, NJ (US); Lucinda Rasmussen, Effort, PA (US); Amy Kreoll, Wharton, NJ (US); Tappan Chatterjee, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 12 days.

(21) Appl. No.: 09/785,995

(22) Filed: Feb. 20, 2001

Related U.S. Application Data

(60) Provisional application No. 60/209,205, filed on Jun. 5, 2000.

(51) Int. Cl.[7] ..... F42B 39/00

(52) U.S. Cl. ..... 206/3; 229/93

(58) Field of Search ..... 206/3, 446; 229/93; 220/8

(56) References Cited

U.S. PATENT DOCUMENTS 1,842,404 A * 1/1932 Hunt ..... 229/125.19
2,268,245 A * 12/1941 Davis ..... 206/445
2,339,298 A * 1/1944 Shepherd ..... 206/3
2,356,969 A * 8/1944 Blum ..... 206/3
2,930,408 A * 3/1960 Stevens ..... 138/103
3,939,967 A * 2/1976 Tenney et al. ..... 206/3
2001/0025805 A1 * 10/2001 Maki et al. ..... 206/710

* cited by examiner

*Primary Examiner*—David T. Fidei
(74) *Attorney, Agent, or Firm*—John F. Moran; Michael C. Sachs

(57) ABSTRACT

A container that is a spirally-wound, laminated, and cylindrically shaped is capable of protecting a mortar or other round from a large number of environmental conditions. The laminate material includes a layer of low-density polyethylene (LDPE) heat-bonded to a kraft paper, and is both durable, strong, and moisture-resistant. During the container manufacturing process, multiple layers of the laminate material, augmented by one or more layers of aluminum foil, are wound in a spiral fashion over an interior cylinder of ammunition container board, using conventional tooling and machinery. Layers of the cylinder are bonded to their contiguous neighbors by adhesive. The ends of the containers are sealed with crimped metal end caps, effecting a durable and moisture-resistance seal and giving the cylinder added crush-resistance. The construction of the container requires no high temperature operations, produces no noxious fumes, and does not expose workers to hazardous or toxic materials. In addition, there is less waste as compared to the current technology.

24 Claims, 4 Drawing Sheets

POLYETHYLENE-LAMINATED FIBER AMMUNITION CONTAINER

RELATED APPLICATION

This application claims benefit of filing date Jun. 5, 2000 of provisional application 60/209,205, the entire file wrapper contents of which application are herewith incorporated by reference as though fully set forth herein at length.

U.S. GOVERNMENT INTEREST

The invention described herein may be made, used, or licensed by of for the U.S. Government for U.S. Government purposes.

FIELD OF THE INVENTION

The invention described herein relates to the field of military packaging requirements and materials for the transportation, handling, and storage of 81 mm and 120 mm Mortar ammunition. Specifically, the present invention relates to fiber ammunition containers employed as the primary means of protection and preservation of the cartridges from the environmental extremes and rough handling scenarios encountered by ammunition throughout its logistic lifecycle.

BACKGROUND OF THE INVENTION

All weapons, ammunition, fire control equipment, vehicles, and sustainability hardware used in military war and peace-time applications are subject to high standards of packaging, transportation, and handling governed by MIL-STD-2073-1, MIL-STD-1904 and MIL-STD-1905, as well the Department of Transportation authored CFR 49. Exemplary cases are relatively lightweight, mobile weapons such as the U.S. Army's 81 mm and 120 mm mortars. The inherent portability, flexibility and ubiquity of these weapons dictate that they and the ammunition they fire will be exposed to a very wide range of non-ideal conditions. In particular, these weapons and their ammunition are expected to perform as designed in conditions that include extreme heat and cold, as well as wet and dusty environs. In addition, ammunition for these mortars is expected to survive high g-loadings such as those that might be experienced when being transported by tracked or wheeled vehicles, carried by soldiers, or delivered by a fixed-wing or a rotary-wing aircraft.

For protection, individual rounds of ammunition for mortars and other large caliber weapons are packaged in individual fiber containers. In addition to this primary packaging method, this protection may be augmented by secondary packaging in metal cans or wooden boxes. However, it may be appreciated that in many circumstances the ammunition must survive without the benefits of secondary packaging, that is, with the only packaging and protection being afforded by the primary container. This is particularly true when the ammunition is transported by soldiers or by vehicles with limited carrying capacity, wherein key considerations are bulk and mass. Specifically, the rounds must survive the non-ideal conditions but the packing must be minimized.

Over the past years primarily asphalt-impregnated fiber ammunition containers specified by MIL-C-2439 have protected mortar rounds in the field. These containers adequately address the transportation, storage and handling issues however asphalt has been highlighted as a substance that is hazardous to the environment. In answer to this, manufacturers who normally use asphalt in their processes have come to develop material replacements. Increased regulatory measures concerning the disposal and use of asphalt has resulted in a decrease in suppliers and an increase in cost. Moreover, "handling hazards" in the container production process, such as the fumes and burns from the asphalt which must be stabilized at a high temperature to maintain the flow, are cause for health-safety concerns and cost increases.

A possible alternative to the asphalt container is the use of the Type IV, wax-impregnated version of MIL-C-2439. Again, however, although this option would resolve the environmental issues, the production issues remain (Manufacturers are subject to high temperature baths of molten wax.) and performance issues are introduced. In the field, the wax-impregnated containers are plagued by distorted or illegible markings. The containers also leave a sticky residue on the user's hands and the ammunition when temperatures exceed the softening point of the wax (approximately 100° Fahrenheit). The wax resin also significantly weakens the adhesion strength between the container inner tube and the outer tube. As a result, the container's structural strength and integrity are compromised by the wax-dipping process.

Consequently, to date, there is no effective means of producing a high-performance, cost-effective, worker-safe, and environmentally sound container for mortar rounds.

SUMMARY OF THE INVENTION

A feature of the present invention is to provide a polyethylene-laminated fiber container that addresses the foregoing concerns. This container allows the manufacturer to produce a fiber tube in a low-temperature, clean-air environment, and ultimately equips the user with a low-cost, highly- durable, water-vapor tight, and light-weight means of transporting and protecting ammunition.

Briefly, the container is a spiral-wound, laminated cylinder capable of protecting a mortar or other round from a large number of environmental conditions. The laminate material, known by the generic name "PolyLam" includes a layer of low-density polyethylene (LDPE) heat-bonded to a kraft paper. The laminate material is both strong and moisture-resistant. During the cylinder manufacturing process, multiple layers of this laminate material, augmented by one or more layers of aluminum foil, are wound in a spiral fashion over an interior cylinder of ammunition container board, using conventional tooling and machinery. Layers of the cylinder are bonded to their contiguous neighbors by adhesive. The ends of the containers are sealed with crimped metal end caps, effecting a durable and moisture-resistance seal and giving the cylinder added crush-resistance. The construction of the containers requires no high temperature operations, produces no noxious fumes, and does not expose workers to hazardous or toxic materials. In addition, there is less waste as compared to the current technology.

Once a round of ammunition is placed in the interior of the fiber container, it is sealed with a pressure sensitive tape, rendering it both easily opened and re-sealed, even under battlefield conditions. The design of the tube allows the fins of the encased mortar round to be grasped for easy removal. In addition, the surface of the container is easily gripped to prevent slippage on the part of the user.

The fiber container of the present invention is used as the primary packaging for individual rounds. While the fiber container will be described herein in connection with mortar ammunition, it is readily adapted to tank ammunition, grenades, and other ammunition families that utilize the fiber or similar container packaging technology.

Each round variation (e.g., 81 mm High-Explosive Cartridges, 81 mm Illuminating Cartridges, 120 mm high-Explosive Cartridges, etc.) has an associated packing and marking drawing for the loading and closure of the ammunition container. There are specially designed fuze supports and cushioning systems for each cartridge that become an integral part of the ammunition tube and, thus, provide superior protection for the mortar round.

Secondary containment of ammunition is used where practicable. Over-packs are generally metal for the combat ammunition and wood for the training ammunition. With a metal over-pack the fiber container is capable of meeting its specifications for a range of temperatures between approximately −65° F. to +160° F. The improved water-vapor resistance of the PolyLam is especially valuable in the case of the training ammunition, as the wood over-pack leaves the ammunition containers much more vulnerable to the elements than the metal cans.

DETAILED DESCRIPTION OF THE PREFERRED EMBODIMENTS

Figure 1:
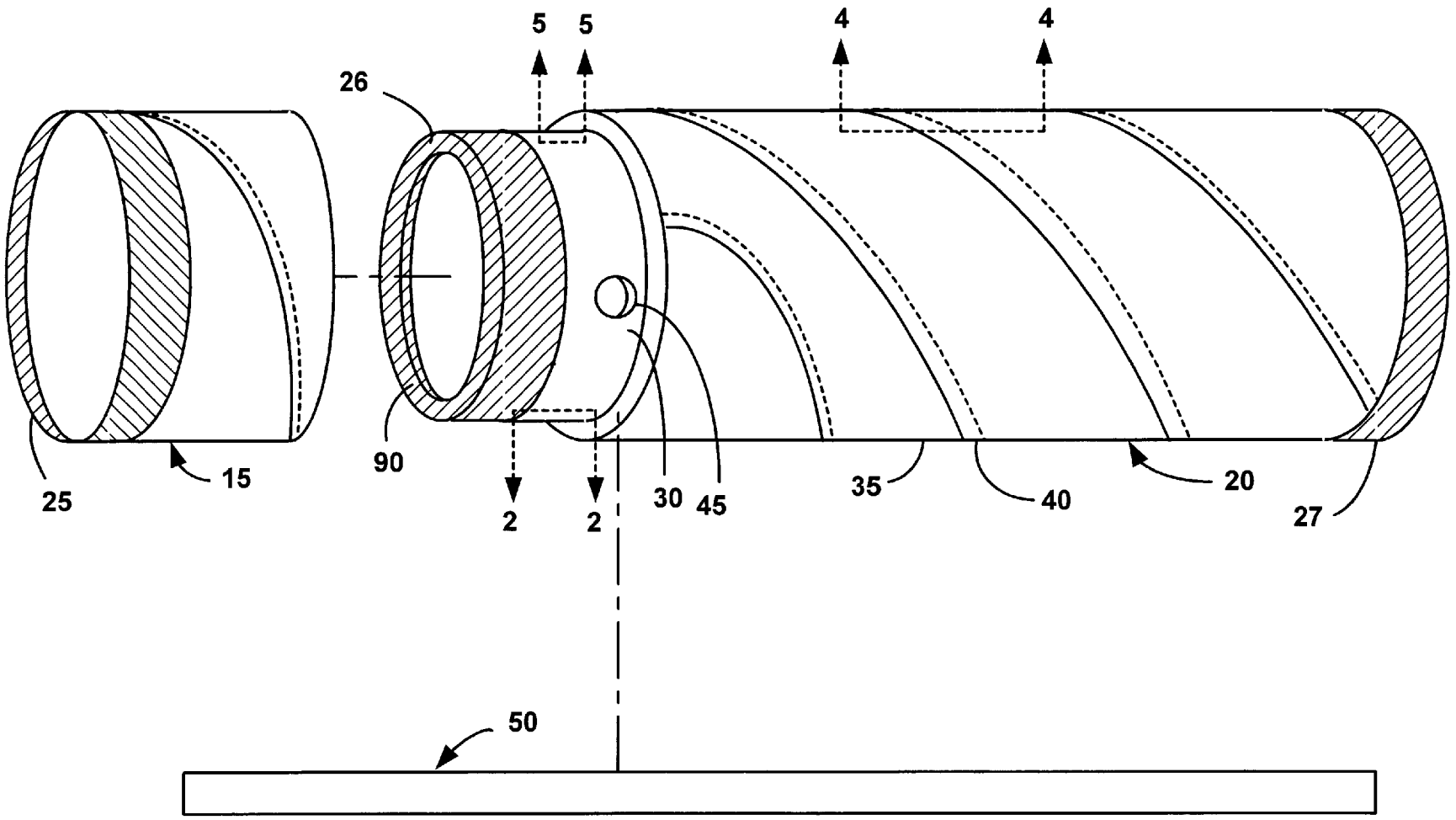
FIG. 1 is an isometric, assembly view of a polyethylene-laminated fiber container of the present invention, comprised of a cylindrical body, a removable cap, and a sealing tape, as applied for primary packaging of a mortar round.

FIG. 1 depicts an isometric view of the overall assembly of a polyethylene-laminated fiber container 10 of the present invention whose main components include a cap 15, a cylindrical body 20, and pressure sensitive sealing tape 50. As illustrated, in the preferred embodiment one end of the cap 15 is sealed with a crimped metal cap seal 25, while the other end is left open so as to fit over the neck or neck tube 30 of the cylindrical body 20. A closed end of the cylindrical body 20 is sealed with a crimped metal cylinder seal 27, while the neck 30 of the open end is finished with a crimped metal neck ring 26. The crimped metal cap seal 25, the metal cylinder seal 27 and metal neck ring 26 are crimped in place during the fabrication process. The pressure-sensitive tape 50 serves to seal the container 10 once the cap 15 and cylinder 20 are mated.

The main components of the cylindrical body 20 are the neck tube 30, an outer tube 35, the metal cylinder seal 27, and the metal neck ring 26. The neck tube 30 and the outer tube 35 are formed by joining, with adhesive, multiple, nested cylindrical layers of container board, aluminum foil and polyethylene laminated material (PolyLam). The cylinder's inherent strength and moisture resistance are due to its construction, which relies on a plurality of lapped, spiral windings.

Displayed in FIG. 1 is an outermost layer 35 of polyethylene laminated (PolyLam) material with emphasis on the lapped, spiral windings 40. The crimped metal end cap 27 seals the closed end of the cylindrical body 20. The metal neck ring 26 is crimped into the neck tube 30 of the cylindrical tube 20, providing protection and rigidity. Also shown is an air-escape hole 45 which is formed laterally in the neck tube 30, to allow the cap 15 to be easily secured to, or removed from the neck tube 30, by minimizing the effects of differential pressure between the interior and exterior of the neck tube 30.

The crimped metal end cap 25 seals the cap 15. The end cap 25 is designed to provide a suitable seal as well as provide necessary additional rigidity to the fiber container 10.

Figure 2:
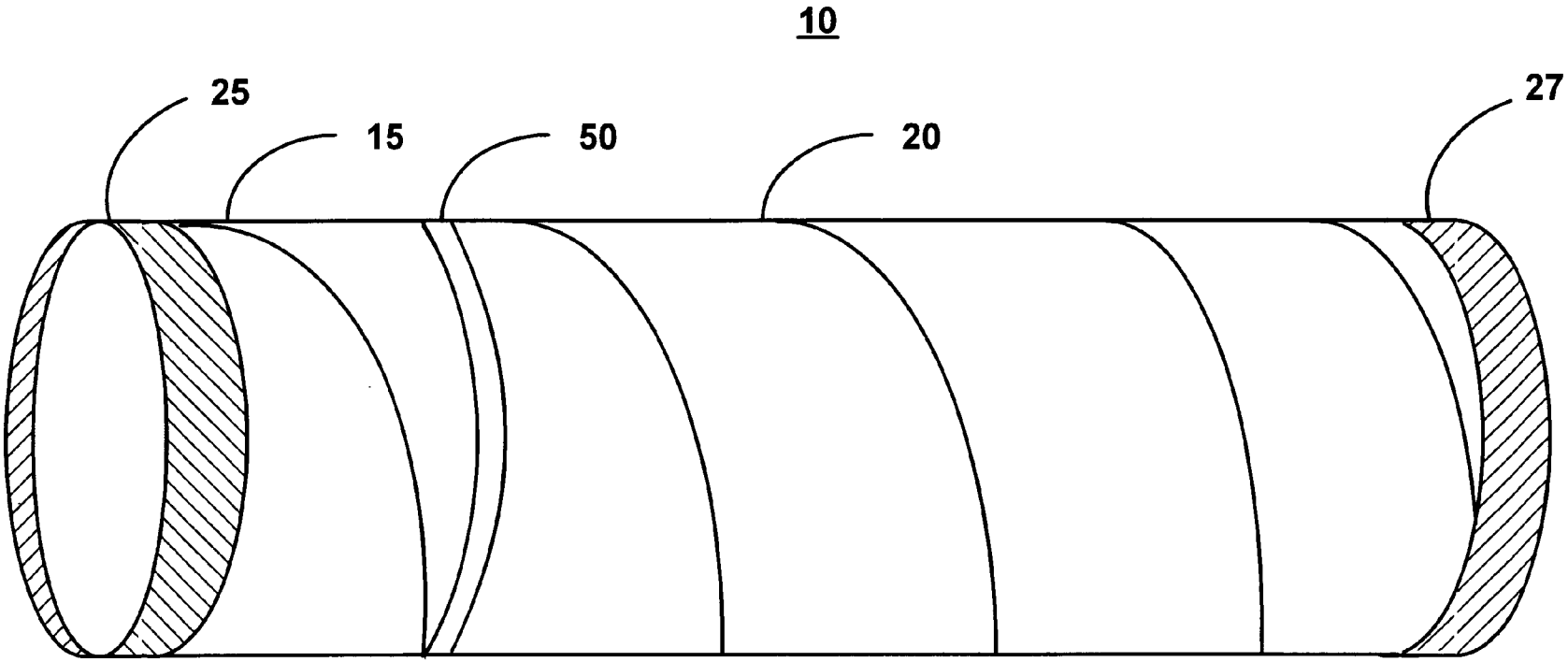
FIG. 2 depicts a view of the polyethylene-laminated fiber container of FIG. 1 with the cap in place and sealed with pressure-sensitive tape.

FIG. 2 depicts a closed and sealed fiber container 10. The cap 15 has been sealed to the open-ended cylinder 20 by means of a pressure-sensitive tape 50, rendering the container 10 dust and moisture resistant. The tape 50 is easily removed and re-sealed without the use of tools, even under battlefield conditions.

Figure 3:
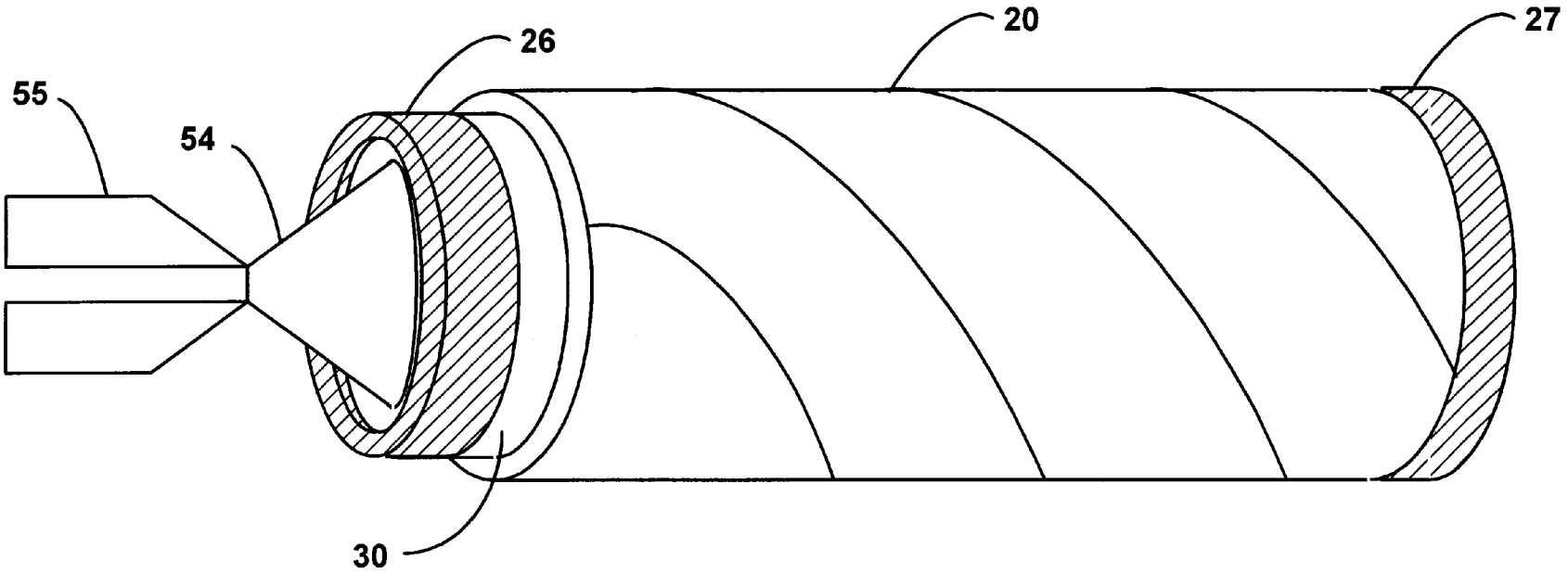
FIG. 3 illustrates a mortar round with its stabilizing fins exposed, encased in the cylindrical body of the fiber container of FIG. 1.

FIG. 3 illustrates additional features of the fiber ammunition container 10. With a mortar round 54 inserted in the open-ended cylinder 20 and with the cap 15 removed, the stabilizing fins 55 of the round 54 are exposed and can be readily gripped by the user. The material properties of the outermost layer or tube 35 of PolyLam material are such that the container 10 is easily gripped and the mortar round 54 is readily removed. In addition, the container surface is compatible with standard inks and labels without the need for special surface treatments.

Figure 4:
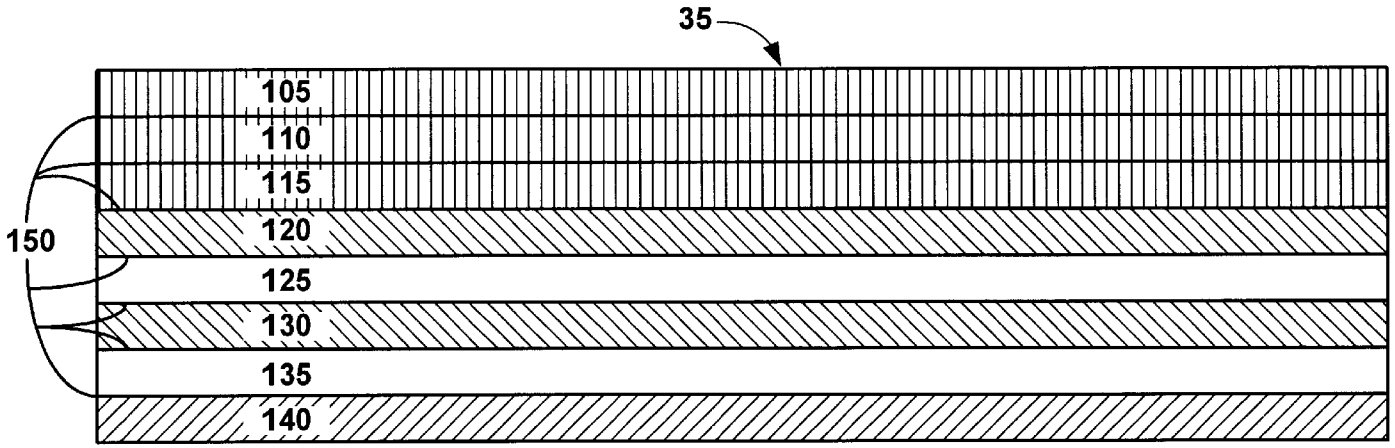
FIG. 4 is a cross sectional view of the cylindrical body of FIG. 1, taken along 4—4, that illustrates the layered construction of an outer tube and an end cap.

FIG. 4 shows the layers of the outer tube 35 of the body 20 and of the cap 15, as exemplified by the outer tube 35 of FIG. 1. According to an exemplary preferred embodiment, the outer tube 35 is comprised of eight layers that are bonded together by intermediate layers of adhesive 150. The layers of the outer tube 35 are as follows:

First (outer) layer 105 is comprised of ammunition container board, in compliance with the U.S. Army's specification A-A-59209.

Second and third layers 110,115, respectively are similar to the first layer 105.

Fourth layer 120 is comprised of polyethylene-laminated (PolyLam) fiber material, such as 30 lb natural kraft, 14 lb low-density polyethylene (LDPE), and 70 lb natural kraft.

Fifth layer 125 is comprised of an aluminum foil.

Sixth layer 130 is comprised of polyethylene-laminated (PolyLam) fiber material, similar to the fourth layer.

Seventh layer 135 is comprised of an aluminum foil, similar to the fifth layer.

Eight (or inner) layer 140 is comprised of polyethylene-laminated (PolyLam) fiber material of a different composition than that of the fourth and sixth layers 120, 130, respectively. For example, the eight layer 140 is comprised of polyethylene-laminated (PolyLam) fiber material made of, for example, 30 lb natural kraft with an exterior layer of 29 lb low-density polyethylene (LDPE).

Figure 5:
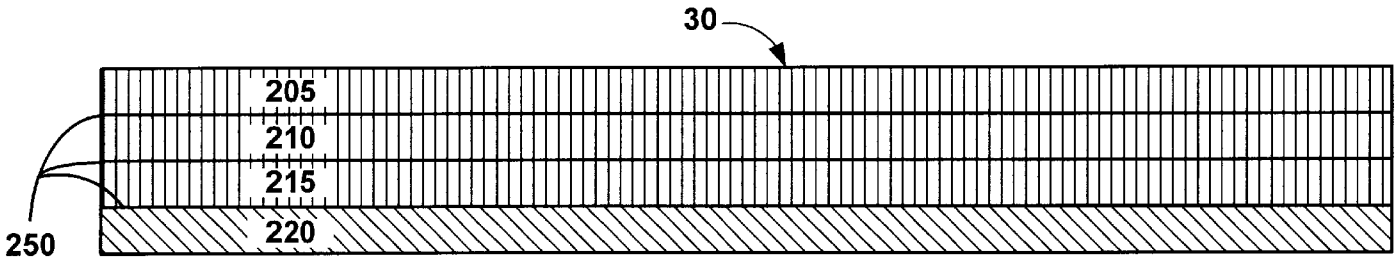
FIG. 5 is a cross sectional view of the cylindrical body of FIG. 1, taken along 5—5, that illustrates the layered construction of a neck tube that forms part of the body.

FIG. 5 shows the various layers of the neck tube 30 of FIG. 1. According to an exemplary preferred embodiment, the neck tube 30 is comprised of four layers that are bonded together by intermediate layers of adhesive 250. The layers of the neck tube 30 are as follows:

First (outer) layer 205 is comprised of ammunition container board, in compliance with the U.S. Army's specification A-A-59209.

Second and third layers 210, 215, respectively are similar to the first layer 205.

Fourth layer 220 is comprised of polyethylene-laminated (PolyLam) fiber material, such as 30 lb natural kraft, 14 lb low-density polyethylene (LDPE), and 70 lb natural kraft.

The foregoing construction presents the present polyethylene-laminated fiber container 10 with numerous advantages among which are the following:

1. The fiber container 10 provides a superior, moisture-resistant container for mortar rounds. It possesses greater durability and strength, and a lower water vapor transmission rate than conventional containers.
2. The fiber container 10 performs better than, or equal to the asphalt and wax-impregnated versions of the fiber tubes.
3. The spiral winding of the laminate gives the fiber container 10 strength and durability and yet makes it relatively easy to manufacture.
4. No special tooling or equipment is required to manufacture the present fiber container 10, with all the constituent materials being commercially available.
5. The fiber container 10 is easily adapted to various types ammunition requiring fiber containers, including, but not limited to tank weapons and artillery.
6. The fiber container 10 can be used as an individual stand-alone package to transport the cartridges in High Mobility Multi-purpose Wheeled Vehicles (HMMWV or "HumVee"), mortar carriers, and other transportation vehicles for field shipments and temporary storage in tactical or training situations.
7. The fiber container 10 is light in weight, i.e., 4.8 pounds for a 32 pound 120 mm mortar round.
8. In situations where added protection is required, the fiber container 10 is designed to function between approximately +160° F. to −65° F. as an inner container, over-packed in a metal container. These requirements include worldwide shipments and storage in the most rigorous environment.
9. The fiber container 10 is cheaper to produce, results in less waste, and is substantially cheaper to dispose of than conventional containers. Added savings are projected to increase as price of asphalt has increased greatly each year.
10. The fiber container 10 is environmentally sound and friendly. The design and manufacturing process are in full compliance with OSHA, EPA, and other safety requirements, as no toxic, hazardous, or environmental unfriendly materials are used in the manufacture of the fiber containers. Disposal costs are significantly reduced as the fiber containers are biodegradable and can be disposed in landfills without further treatments.
11. The production of the container fiber 10 produces none of the worker hazards associated with the asphalt- or wax-impregnated containers.
12. The fiber container 10 is easily opened and closed under battlefield conditions without tools. A pressure sensitive tape seals the fiber container. In addition, the surface of the container 10 is easily gripped, preventing slippage.
13. Mortar rounds are easily pulled from the container by grasping the stabilizing fins even with gloved hands required in low temperature, biological or chemical environments.
14. The fiber container surface is compatible with standard inks and labels without the need for special surface treatments.
15. Integral fuse supports and cushioning systems are integral to the fiber container 10 and may be readily customized for variants in ammunition (high explosive, illumination, fragmentation, etc.).
16. The fiber container 10 poses none of the transportation and handling problems associated with the asphalt-coated containers.

It is to be understood that the specific embodiments of the invention that have been described are merely illustrative of certain application of the principle of the present invention. Numerous modifications may be made to the fiber container 10 described herein without departing from the spirit and scope of the present invention.

What is claimed is:

1. A polyethylene-laminated fiber container for use in storing a round of ammunition, comprising:

a cylindrical body having:

an open ended, cylindrically shaped neck with a reduced diameter;

a closed end; and a cylindrically shaped outer tube that extends integrally from the neck to the closed end of the cylindrical body;

a cylindrically shaped cap having an open end and a closed end, wherein the open wend of the cap fits over and mates with the neck;

a pressure sensitive sealing tape for placement over part of the cap and part of the outer tube once the cap and cylindrical body are mated, to seal the container;

wherein the neck and outer tube are formed of a plurality of spirally wound, lapped layers of: container board, aluminum foil, and polyethylene laminated material, for strength and moisture resistance; and wherein the closed end of the cap is sealed with a crimped metal cap seal.

2. The fiber container of claim 1, wherein the open end of the cap fits over the neck of the cylindrical body.

3. The fiber container of claim 2, wherein the closed end of the cylindrical body is sealed with a crimped metallic seal.

4. The fiber container of claim 3, wherein the neck of the cylindrical body is fitted with a reinforcing crimped metallic ring.

5. The fiber container of claim 1, wherein the round of ammunition includes a cartridge having a body and fins;

wherein the cartridge body is stored in an interior space formed by the cylindrical body; and wherein the cartridge fins extend, at least in part, outside the neck, and are encased by the cap when the cap and cylindrical body are mated.

6. A polyethylene-laminated fiber container for use in storing a round of ammunition, comprising:

a cylindrical body having:

an open ended, cylindrically shaped neck with a reduced diameter;

a closed end; and a cylindrically shaped outer tube that extends integrally from the neck to the closed end of the cylindrical body;

a cylindrically shaped cap having an open end and a closed end, wherein the open end of the cap fits over and mates with the neck;

a pressure sensitive sealing tape for placement over part of the cap and part of the outer tube once the cap and cylindrical body are mated, to seal the container;

wherein the neck and outer tube are formed of a plurality of spirally wound, lapped layers of: container board, aluminum foil, and polyethylene laminated material, for strength and moisture resistance; and wherein the neck includes an air-escape hole which is formed laterally in the neck, to allow the cap to be easily secured to, or removed from the neck, by minimizing the effect of differential pressure between the interior and exterior of the neck.

7. The fiber container of claim 1, wherein the plurality of layers of the outer tube are comprised of eight laminates that are bonded together by intermediate layers of adhesive.

8. The fiber container of claim 7, wherein the laminates include:

first, second, and third layers of ammunition container board;

a fourth layer comprised of polyethylene-laminated fiber material;

a fifth layer comprised of an aluminum foil;

a sixth layer comprised of polyethylene-laminated fiber material having a generally similar construction to the fourth layer;

a seventh layer comprised of an aluminum foil having a generally similar construction to the fifth layer;

an eight layer comprised of polyethylene-laminated fiber material of a different composition than that of the fourth and sixth layers.

9. The fiber container of claim 8, wherein the polyethylene-laminated fiber material includes any one or more of: 30 lb natural kraft, 14 lb low-density polyethylene (LDPE), or 70 lb natural kraft.

10. The fiber container of claim 8, wherein the eight layer is comprised of polyethylene-laminated fiber material made of 30 lb natural kraft with an exterior layer of 29 lb low-density polyethylene.

11. The fiber container of claim 8, wherein the plurality of layers of the cap are comprised of four laminates that are bonded together by intermediate layers of adhesive.

12. The fiber container of claim 11, wherein the laminates include: first, second, and third layers of ammunition container board; and a fourth layer comprised of polyethylene-laminated fiber material.

13. The fiber container of claim 12, wherein the fourth layer is comprised of polyethylene-laminated fiber material made of any one or more of: 30 lb natural kraft, 14 lb low-density polyethylene, or 70 lb natural kraft.

14. The fiber container of claim 6, wherein the open end of the cap fits over the neck of the cylindrical body.

15. The fiber container of claim 14, wherein the closed end of the cylindrical body is sealed with a crimped metallic seal.

16. The fiber container of claim 15, wherein the neck of the cylindrical body is fitted with a reinforcing crimped metallic ring.

17. The fiber container of claim 6, wherein the round of ammunition includes a cartridge having a body and fins;

wherein the cartridge body is stored in an interior space formed by the cylindrical body; and wherein the cartridge fins extend, at least in part, outside the neck, and are encased by the cap when the cap and cylindrical body are mated.

18. The fiber container of claim 6, wherein the plurality of layers of the outer tube are comprised of eight laminates that are bonded together by intermediate layers of adhesive.

19. The fiber container of claim 18, wherein the laminates include:

first, second, and third layers of ammunition container board;

a fourth layer comprised of polyethylene-laminated fiber material;

a fifth layer comprised of an aluminum foil;

a sixth layer comprised of polyethylene-laminated fiber material having a generally similar construction to the fourth layer;

a seventh layer comprised of an aluminum foil having a generally similar construction to the fifth layer;

an eight layer comprised of polyethylene-laminated fiber material of a different composition than that of the fourth and sixth layers.

20. The fiber container of claim 19, wherein the polyethylene-laminated fiber material includes any one or more of: 30 lb natural kraft, 14 lb low-density polyethylene, or 70 lb natural kraft.

21. The fiber container of claim 19, wherein the eight layer is comprised of polyethylene-laminated fiber material made of 30 lb natural kraft with an exterior layer of 29 lb low-density polyethylene.

22. The fiber container of claim 19, wherein the plurality of layers of the cap are comprised of four laminates that are bonded together by intermediate layers of adhesive.

23. The fiber container of claim 22, wherein the laminates include:

first, second, and third layers of ammunition container board; and a fourth layer comprised of polyethylene-laminated fiber material.

24. The fiber container of claim 23, wherein the fourth layer is comprised of polyethylene-laminated fiber material made of any one or more of: 30 lb natural kraft, 14 lb low-density polyethylene, or 70 lb natural kraft.

* * * * *